US005447244A

United States Patent [19]

Mentzer

[11] Patent Number: 5,447,244

[45] Date of Patent: Sep. 5, 1995

[54] TOWEL CURTAIN ASSEMBLY AND METHOD

[76] Inventor: Brian Mentzer, Rte. 1, Box 366, Purcellville, Va. 22132

[21] Appl. No.: 207,636

[22] Filed: Mar. 9, 1994

[51] Int. Cl.[6] ..... A47H 1/00

[52] U.S. Cl. ..... 211/123; 211/105.1; 160/330; 160/DIG. 6; 4/558; 4/605

[58] Field of Search ..... 160/330, 350, 123, 124, 160/335, 336, 405, DIG. 6; 4/558, 559, 605, 608; 211/16, 123, 124, 105.1, 86, 96

[56] References Cited

U.S. PATENT DOCUMENTS

| | | | |
|---|---|---|---|
| D. 265,875 | 8/1982 | Wolf et al. . | |
| D. 286,237 | 10/1986 | Muderlak . | |
| D. 296,402 | 6/1988 | Fortes . | |
| 1,926,636 | 9/1933 | Subick | 211/96 X |
| 2,046,824 | 7/1936 | Kenny | 160/335 X |
| 2,472,480 | 6/1949 | Huhn | 211/86 |
| 2,941,671 | 6/1960 | Lewis et al. | 211/86 |
| 2,997,182 | 8/1961 | Lewis et al. | 211/86 |
| 3,104,014 | 9/1963 | Piette | 160/124 X |
| 3,307,710 | 3/1967 | Negri | 211/86 |
| 3,451,558 | 6/1969 | Cohen | 211/86 |
| 4,033,538 | 7/1977 | Levy | 211/86 X |
| 4,108,314 | 8/1978 | Racca . | |
| 4,112,525 | 9/1978 | Roberts | 211/96 X |
| 4,123,024 | 10/1978 | Levy | 211/86 X |
| 4,702,381 | 10/1987 | Carter et al. | 211/123 X |
| 4,953,603 | 9/1990 | Holden . | |
| 4,979,712 | 12/1990 | Rios . | |
| 5,087,007 | 2/1992 | Gaderick . | |
| 5,161,683 | 11/1992 | Smith . | |

*Primary Examiner*—David M. Purol

*Attorney, Agent, or Firm*—Kerkam, Stowell, Kondracki & Clarke; William L. Feeney

[57] ABSTRACT

A towel curtain assembly attaches to a shower curtain rod, top of a shower door, or towel rack within a shower enclosure to allow easy access to a towel. The assembly has a towel curtain which shields the towel from water even when the shower is in use. A pivot mount pivotably mounts a towel curtain rod to a gripper which secures the assembly to the shower curtain rod or other support.

20 Claims, 4 Drawing Sheets

FIG. 2
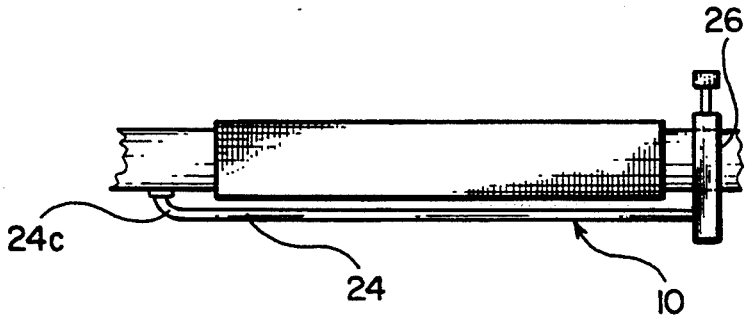
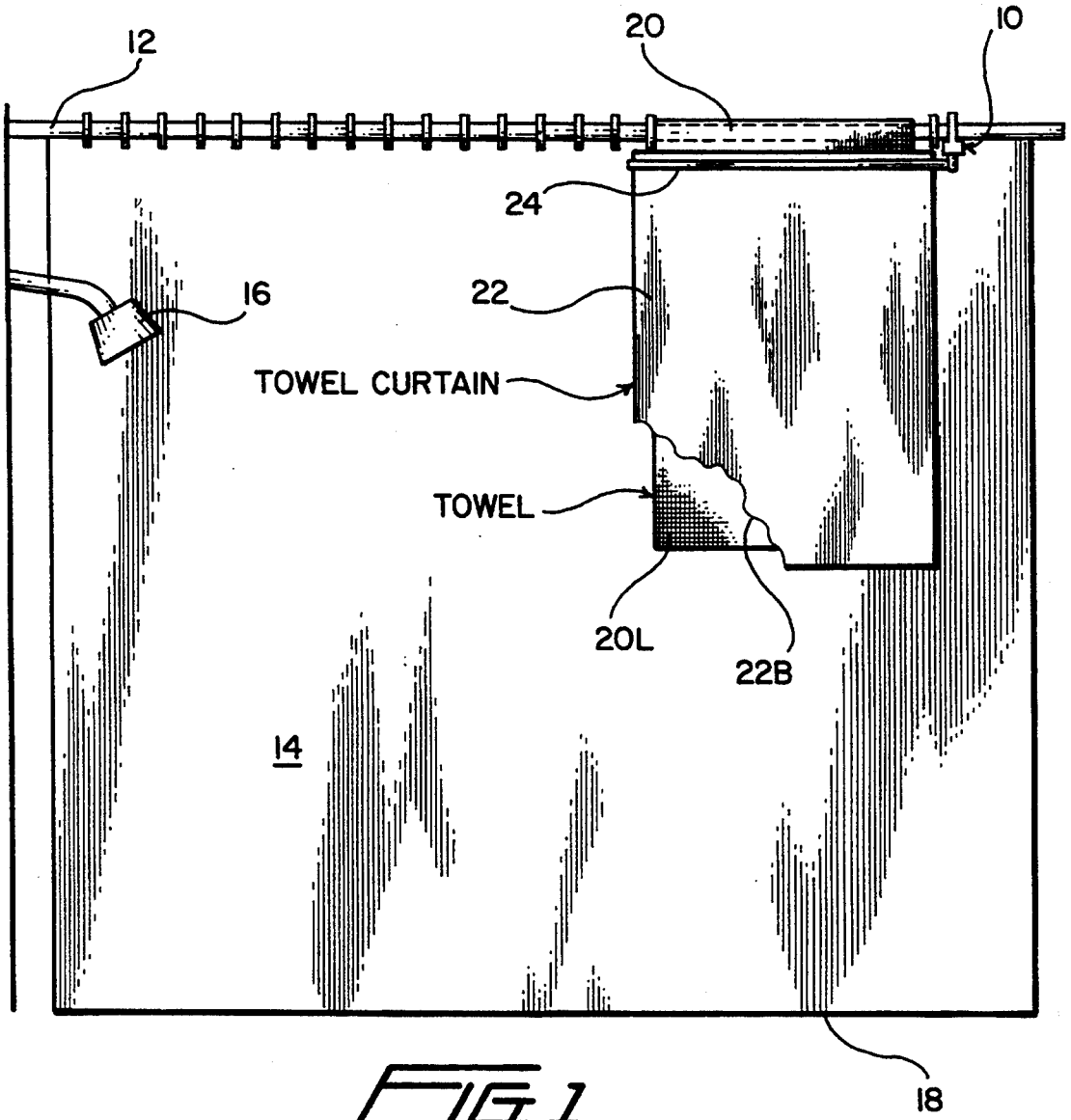
FIG. 1

TOWEL CURTAIN ASSEMBLY AND METHOD

BACKGROUND OF THE INVENTION

This invention relates to a towel curtain assembly which keeps a towel dry when it is in a shower enclosure in use (i.e., the shower is turned on). It also relates to a method of using such an assembly.

When people take showers, there often are problems associated with drying themselves.

Although some shower enclosures have towel racks within the enclosure, placing a towel on such racks during a shower usually will result in the towel getting wet. Likewise, if one puts the towel on the shower rod or top of the shower door, the portion of the towel within the shower enclosure often gets wet.

Leaving the towel outside of the shower enclosure avoids the towel getting wet, but may create other problems. When one steps out of the shower or opens the shower curtain or door to reach out and pull a towel into the shower enclosure, one is hit with a cold burst of air. Even for those who don't get uncomfortable from the cold air, getting out (before one is dry) or reaching out usually causes water to drip on the bathroom floor.

U.S. Pat. No. 4,979,712, issued Dec. 25, 1990 to Rios, discloses a towel holder for shower enclosures. The towel holder allows one to pull a towel from outside the shower enclosure to inside the enclosure after the shower is turned off. Although this is generally useful, it may be difficult for a short person, such as a child, to lift this towel holder sufficiently high that the towel will clear the closed shower door or curtain. If the towel brushes the top of the door or the shower rod, the towel may fall off the holder if one doesn't orient it right. If a child or other person is sufficiently short, they may not be able to reach the holder.

OBJECTS AND SUMMARY OF THE INVENTION

Accordingly, it is a primary object of the present invention to provide an improved technique for keeping towels dry and easily accessible when taking a shower.

Yet another object of the present invention is to provide an arrangement for keeping a towel dry while it is on a shower curtain rod, top of a shower door, or towel rack within a shower enclosure.

A still further object of the present invention is to provide an arrangement for keeping a towel dry and which is adjustable for use with shower enclosures whether the shower door is to the right or to the left of the shower head.

The above and other objects of the present invention are realized by a towel curtain assembly. The towel curtain assembly includes: a gripper for gripping a support; a pivot mount attached to a first end of the gripper; a towel curtain rod pivotably mounted to the pivot mount; and a towel curtain mounted on the towel curtain rod. The gripper allows the assembly to be mounted on a shower rod, top of a shower door, or towel rack within a shower enclosure. A towel placed on the shower rod, top of shower door, or the towel rack is kept dry by the towel curtain shielding the towel from water.

More specifically, the towel curtain rod has a mount end, a curved rod end opposite the mount end, and a straight section between the mount end and the curved rod end. The curved rod end is rotatable relative to the straight section. The mount end has a hole and the pivot mount has a cylinder extending into the hole for rotatably bearing movement of the towel curtain rod relative to the pivot mount. The hole extends completely through the mount end and the cylinder extends completely through the hole. The pivot mount further includes an enlarged end blocking the mount end from moving off the pivot mount. The gripper has opposing first and second grip surfaces. The first grip surface is movably mounted for moving relative to the second grip surface for gripping a support. The gripper has a frame member with the first and second grip surfaces mounted at opposite ends thereof. The first and second grip surfaces are each rotatable relative to the frame and the first grip surface has a bolt adjustably holding it to the frame.

The invention may alternate be described as a towel curtain assembly including: a gripper having opposing first and second grip surfaces, the first grip surface movably mounted for moving relative to the second grip surface for gripping a support; a mount attached to a first end of the gripper; a towel curtain rod mounted to the mount, the towel curtain rod mountable to the mount in at least two different orientations; and a towel curtain mounted on the towel curtain rod. The towel curtain rod has a mount end, a curved rod end opposite the mount end, and a straight section between the mount end and the curved rod end. The curved rod end is rotatable relative to the straight section. The mount end has a hole and the mount is a pivot mount having a cylinder extending into the hole for rotatably bearing movement of the towel curtain rod relative to the pivot mount. The hole extends completely through the mount end and the cylinder extends completely through the hole. The pivot mount further includes an enlarged end blocking the mount end from moving off the pivot mount. The gripper has a frame member with the first and second grip surfaces mounted at opposite ends thereof. The first and second grip surfaces are each rotatable relative to the frame and the first grip surface has a bolt adjustably holding it to the frame.

The method of the present invention is a method of keeping a towel dry within a shower in use. The steps are: gripping a support in or immediately adjacent to a shower enclosure using a gripper of a towel curtain assembly, the towel curtain assembly including: a mount attached to a first end of the gripper, a towel curtain rod mounted to the mount, the towel curtain rod mountable to the mount in at least two different orientations, and a towel curtain mounted on the towel curtain rod, the towel curtain rod and the towel curtain; and placing a towel on the support with at least a portion of the towel inside the shower enclosure and shielded from water by the towel curtain. More specifically, the method uses a towel curtain assembly wherein the gripper has first and second grip surfaces, and the gripping step is performed by moving the first grip surface relative to the second grip surface to clamp the support therebetween; and wherein the mount end has a hole and the mount is a pivot mount having a cylinder extending into the hole for rotatably bearing movement of the towel curtain rod relative to the pivot mount. The support is a shower rod to which the towel curtain assembly is gripped. Alternately, the support is a top of a shower door to which the towel curtain assembly is gripped. As another alternative, the support is a towel rod within the shower enclosure.

BRIEF DESCRIPTION OF THE DRAWINGS

The above and other features of the present invention will be more readily understood when the following detailed description is considered in conjunction with the accompanying drawings wherein like characters represent like parts throughout and in which:

FIG. 1 is a side view showing a towel curtain assembly according to the present invention mounted on the interior side of a shower curtain rod;

FIG. 2 is a top view of portions of the FIG. 1;

DETAILED DESCRIPTION

Figure 4:
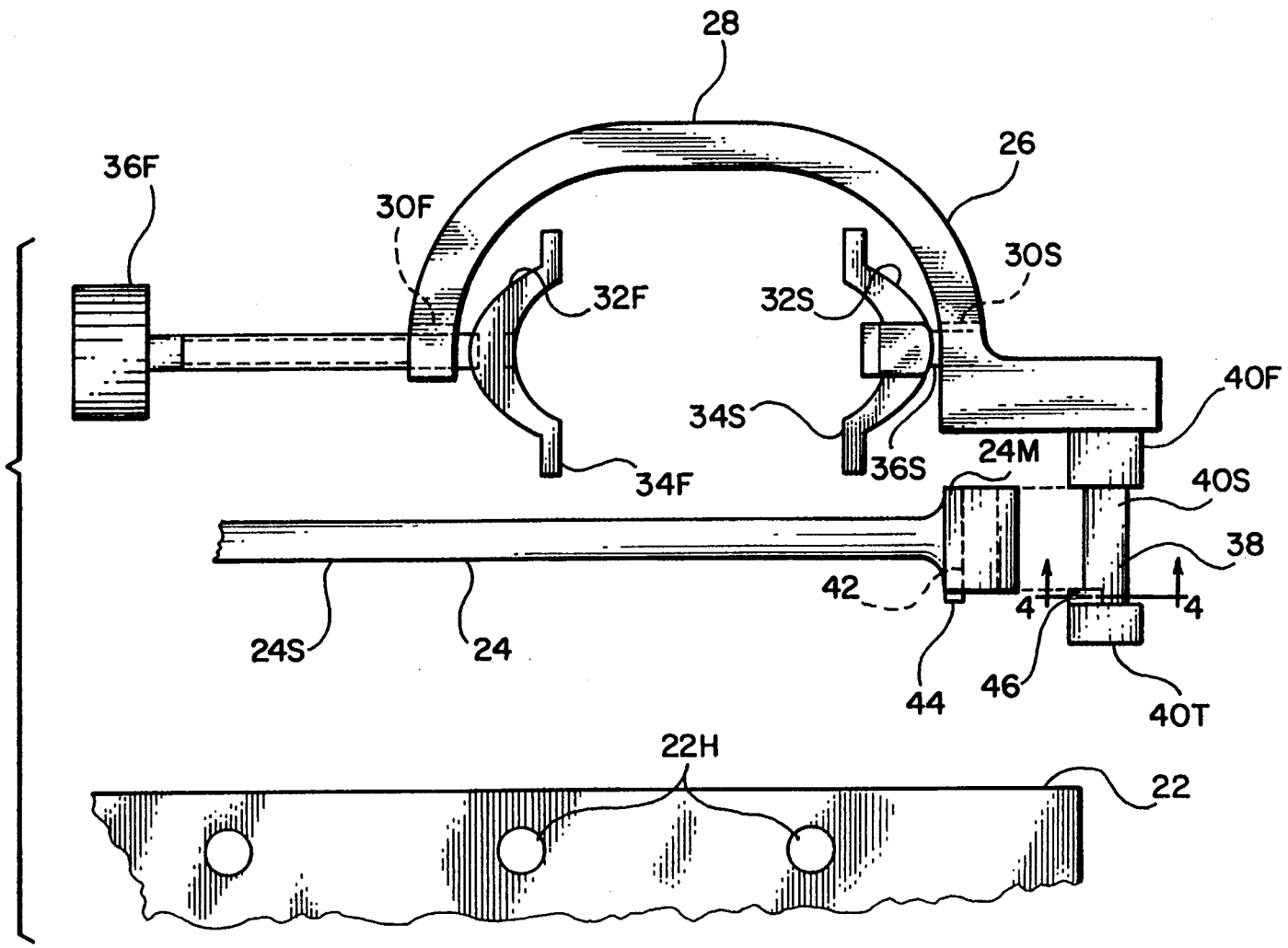
FIG. 4 is a partial cross-section side view taken along lines 4—4 of FIG. 3 illustrating the pivot mount used with the present invention.

With reference now to FIGS. 1 and 2, a towel curtain assembly 10 according to the present invention is shown mounted on a shower curtain rod (shower rod) 12. The assembly 10 is primarily within a shower enclosure 14 disposed under and adjacent to a shower head 16 and partially enclosed by a shower curtain 18.

A towel 20 is placed over the shower rod 12 and extends into the shower enclosure 14. However, most of the portion of towel 20 within the shower enclosure 14 is shielded from water by a towel curtain 22, mounted by illustrated holes 22H upon a towel curtain rod 24 in accord with the assembly 10 according to the present invention. A lower portion 20L of the towel 20 is visible at the lower left of towel curtain 22 where a portion 22B has been broken away for illustrative purposes only. The towel curtain rod 24 is shown mounted in a first orientation extending generally along and to a side of the support or shower curtain rod 12. Therefore, and as shown in FIG. 1, the towel curtain 22 is mounted on the rod 24 such that a towel 20 placed on the support will be shielded from water by the towel curtain 22.

Upon completing one's shower, the shower head 16 can be turned off in the usual fashion. For ease of illustration, faucets are not shown. After turning off the water, one can simply lift the lower part of towel curtain 22 and pull out the towel 20. Even a relatively short person, such as a child, should be able to reach the bottom of the towel adjacent to corner or lower portion 20L illustrated.

Accordingly, the present invention will avoid one having to subject oneself to the cold air upon leaving the shower enclosure while still wet. Instead, one can towel dry themselves without leaving the shower enclosure or even opening the curtain or door in order to reach for a towel. Additionally, water will be kept from getting on the bathroom floor since the person may be dried before they leave the enclosure. Further, this reduces the chance of injury such as caused by slipping when trying to retrieve a towel outside of the shower, either reaching from inside the shower or slipping on the wet floor outside of the shower.

Continuing to view FIGS. 1 and 2, the towel curtain 22 (FIG. 1 only) hangs from the towel curtain rod 24 which is attached to a gripper 26 of the assembly 10. Before describing these parts in more detail, it will briefly be noted that the gripper 26 allows the assembly 10 to be mounted upon a shower rod, top of a shower door, and on a towel rack within a shower enclosure.

Figure 3:
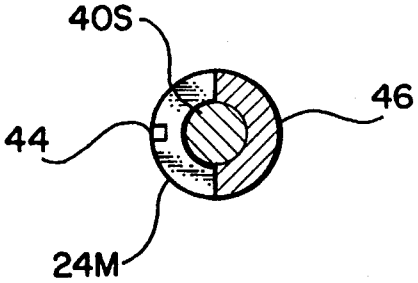
FIG. 3 is a detailed side view, with parts exploded, of a mount end of the present assembly.
Figure 5:
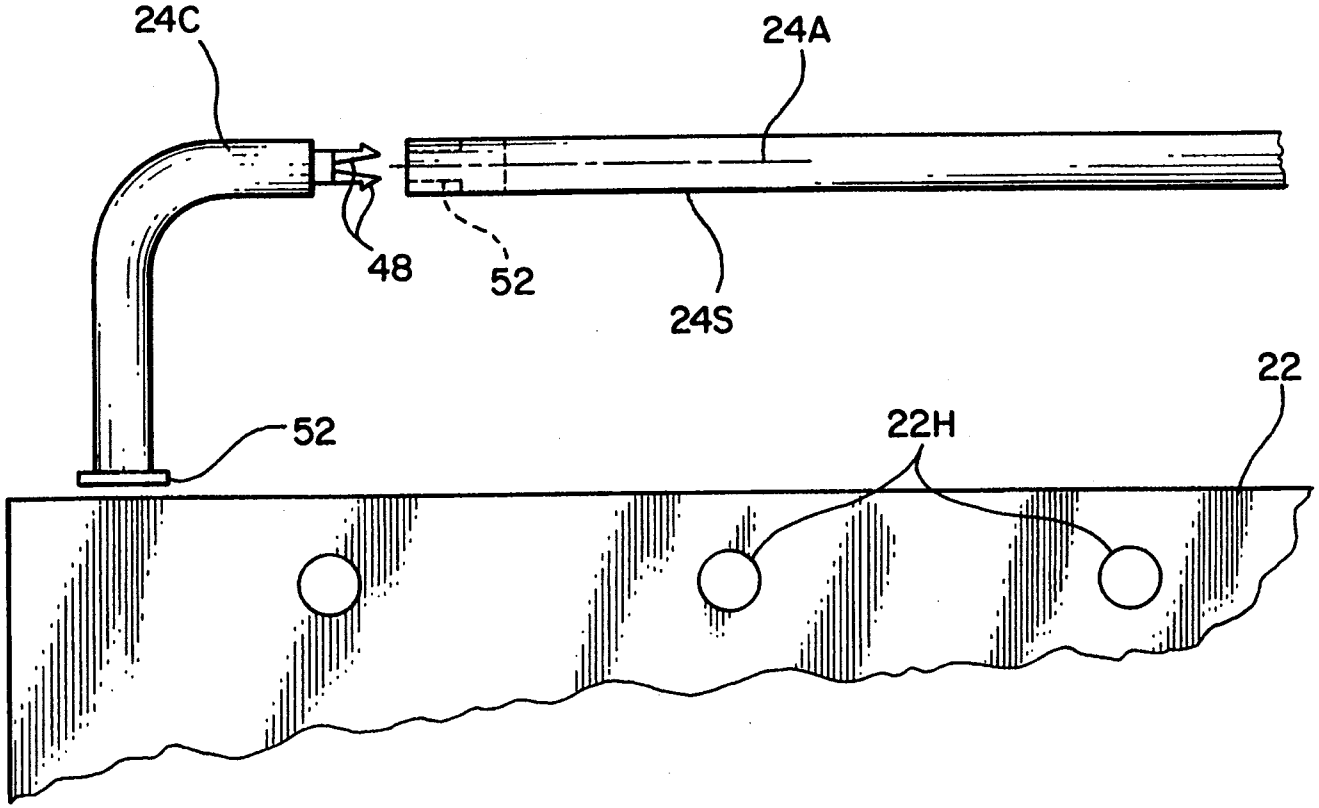
FIG. 5 is detailed side view of the end of the present assembly which is opposite the mount end.

With reference now to FIGS. 3, 4, and 5, the details of construction of the assembly 10 will be discussed. It should initially be understood that all of the parts are preferably made of plastic such that they will be easy to clean and will hold up well in the generally humid environment of a bathroom. However, other materials might be used.

The gripper 26 has a curved frame member 28 with opposing first and second holes 30F and 30S respectively. Holes 30F and 30S respectively mount first and second swivel grips 32F and 32S. Each of the grips 32F and 32S have respective corresponding first and second grip surfaces 34F and 34S. Grip 32S is pivotably mounted to hole 30S by way of bolt 36S in known fashion. Grip 32F is mounted to the hole 30F by way of butterfly bolt 36F. The grip 32F may be fixed to the end of bolt 36F or may be pivotably secured to the end of the bolt using known techniques. By screwing the bolt 36F further into the hole 30F, the grip 32F moves closer to grip 32S such that the two opposing grips may grip or clamp onto a shower rod, top of a shower door, or a towel rack within a shower enclosure.

Frame member 28 has a mount end portion 28M with a pivot mount 38 thereon. Pivot mount 38 includes first, second, and third cylindrical portions 40F, 40S, and 40T with middle portion 40S having a reduced diameter compared to the other two portions. This allows portion 40S to extend through a hole 42 (whose interior surface is a bearing surface rotably bearing against the portion 40S for pivoting of the rod 24 about a vertical axis corresponding to portion 40S) on a mount end 24M of the shower curtain rod 24. Thus, the mount end 24M is captured between portions 40F and 40T. Thus, this provides a pivot connection between the towel curtain rod and the mount, the mount being a pivot mount 38 pivotably mounting the towel curtain rod directly thereto.

A tab 44 is disposed on mount end 24M and serves to limit the angular pivoting of rod 24 to the 180 degrees between opposite sides (stops) of a semicylindrical portion 46 fixed about half of portion 40F as shown in FIG. 4. Other arrangements for limiting this pivoting could of course be used. If desired, a removable pin (not shown) could be used to selectively lock mount end 24M to mount 38 by extending through holes (not shown) in registry in parts 24M and 38. Several such holes would allow one to secure the parts at various angles relative to each other.

Figure 6:
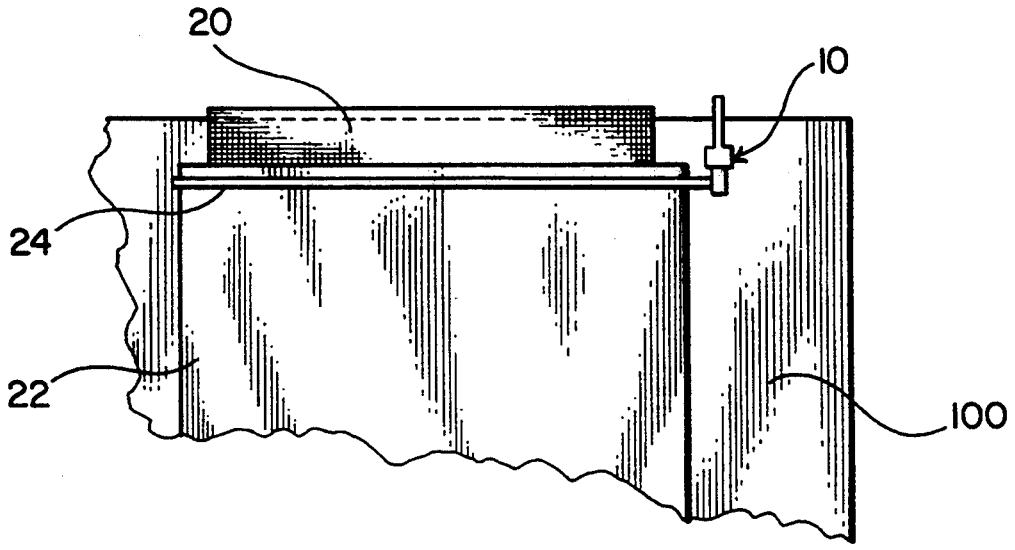
FIG. 6 is a side view of the towel curtain assembly mounted to a shower door.
Figure 7:
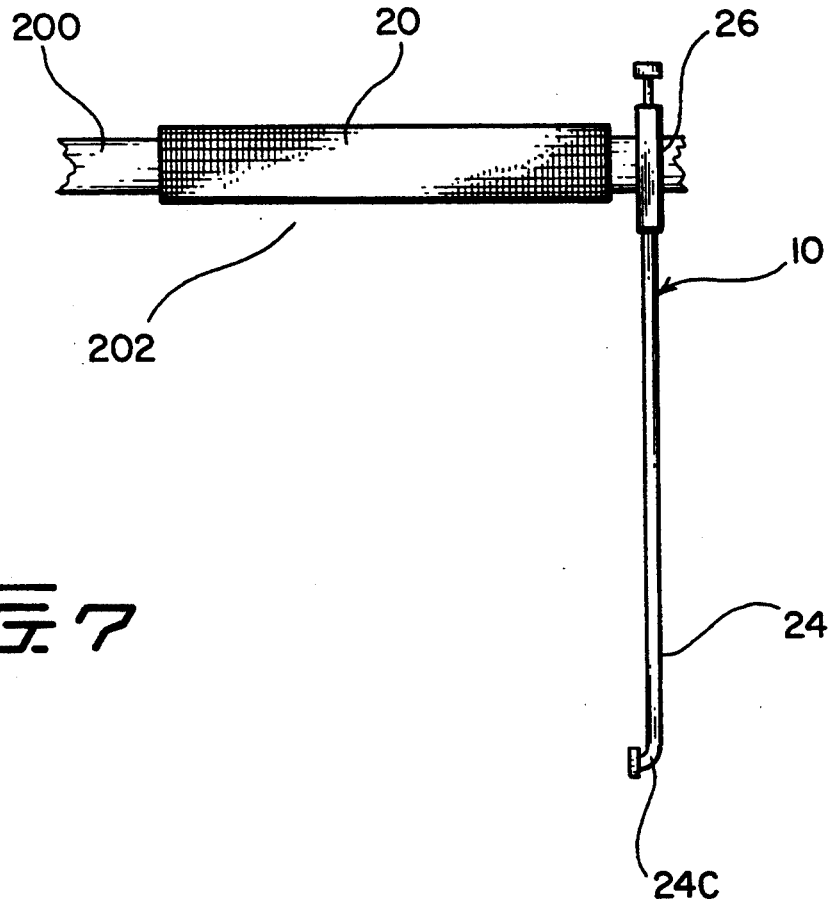
FIG. 7 is a top view of the towel curtain assembly mounted to a towel rod within a shower enclosure.

The towel curtain rod 24 has a straight section 24S between its mount end 24M and a curved end 24C, which is a separate piece pivotably secured to straight portion 24S by resilient hooks 48 hooking to an inner sleeve 50 within straight portion 24S. A flange 52 is disposed at the very end of curved end 24C to prevent the curtain 22 from coming off rod 24. The curve in portion or end 24C allows the curtain 22 to wrap around the edge of towel 20 (refer back to FIG. 2) closest to the shower head 16 in FIG. 1. If the shower head 16 was on the right side of FIG. 1 instead of the illustrated position, the pivoting of mount end 24M about mount 38 will allow the curved end 24C to be closest the shower head, whereas rotation of curved end 24C about axis 24A in FIG. 5 will allow flange 52 to rest on the shower curtain and have the best orientation to protect a towel from water. FIG. 6 shows the assembly 10 mounted to the top of a shower door 100, whereas FIG. 7 shows the assembly 10 mounted to a towel rod 200 (which towel rod is within a shower enclosure 202). FIG. 7 has the rod 24 extending horizontally and away from the support or towel rod 200, this position resulting from the pivoting of the rod in the manner discussed above relative to FIG. 4.

Although various specific constructions have been shown and discussed, it is understood that these are for illustrative purposes only. Various modifications and adaptions will be apparent to those of skill in the art. Accordingly, the scope of the present invention should be determined by reference to the claims appended hereto.

What is claimed is:

1. A towel curtain assembly for keeping a towel dry within a shower in use comprising:

a gripper for gripping a support;

a pivot mount attached to a first end of said gripper;

a towel curtain rod pivotably mounted to said pivot mount; and a towel curtain mounted on said towel curtain rod, and wherein said towel curtain rod has a bearing surface for rotatably bearing against said pivot mount, said towel curtain rod being pivotable about a vertical axis relative to said pivot mount.

2. A towel curtain assembly for keeping a towel dry within a shower in use comprising:

a gripper for gripping a support;

a pivot mount attached to a first end of said gripper;

a towel curtain rod pivotably mounted to said pivot mount; and a towel curtain mounted on said towel curtain rod; and wherein said towel curtain rod has a mount end and wherein said mount end has a hole and said pivot mount has a cylinder extending into said hole for rotatably bearing movement of said towel curtain rod relative to said pivot mount.

3. The towel curtain assembly of claim 2 wherein said towel curtain rod further has a curved rod end opposite the mount end and a straight section between the mount end and the curved rod end.

4. The towel curtain assembly of claim 2 wherein said hole extends completely through said mount end and said cylinder extends completely through said hole, said pivot mount further including an enlarged end blocking said mount end from moving off said pivot mount.

5. The towel curtain assembly of claim 2 wherein said gripper has opposing first and second grip surfaces, said first grip surface movably mounted for moving relative to said second grip surface for gripping a support.

6. The towel curtain assembly of claim 5 wherein said gripper has a frame member with said first and second grip surfaces mounted at opposite ends thereof.

7. The towel curtain assembly of claim 6 wherein said first and second grip surfaces are each rotatable relative to said frame and said first grip surface has a bolt adjustably holding it to said frame.

8. A towel curtain assembly for keeping a towel dry within a shower in use comprising:

a gripper having opposing first and second grip surfaces, said first grip surface movably mounted for moving relative to said second grip surface for gripping a support;

a mount attached to a first end of said gripper;

a towel curtain rod mounted to said mount, said towel curtain rod mountable to said mount in at least two different orientations;

a towel curtain mounted on said towel curtain rod; and a pivot connection between said towel curtain rod and said mount, said mount being a pivot mount pivotably mounting said towel curtain rod directly thereto.

9. The towel curtain assembly of claim 8 wherein said towel curtain rod has a mount end, a curved rod end opposite the mount end, and a straight section between the mount end and the curved rod end.

10. The towel curtain assembly of claim 8 wherein said mount end has a hole and said mount is a pivot mount having a cylinder extending into said hole for rotatably bearing movement of said towel curtain rod relative to said pivot mount.

11. The towel curtain assembly of claim 10 wherein said hole extends completely through said mount end and said cylinder extends completely through said hole, said pivot mount further including an enlarged end blocking said mount end from moving off said pivot mount.

12. The towel curtain assembly of claim 8 wherein said gripper has a frame member with said first and second grip surfaces mounted at opposite ends thereof.

13. The towel curtain assembly of claim 12 wherein said first and second grip surfaces are each rotatable relative to said frame and said first grip surface has a bolt adjustably holding it to said frame.

14. A method of keeping a towel dry within a shower in use, the steps comprising:

gripping a support in or immediately adjacent to a shower enclosure using a gripper of a towel curtain assembly, said towel curtain assembly including: a mount attached to a first end of said gripper, a towel curtain rod mounted to said mount, said towel curtain rod mountable to said mount in at least two different orientations, and a towel curtain mounted on said towel curtain rod, said towel curtain rod and said towel curtain being within the shower enclosure; and placing a towel on the support with at least a portion of the towel inside the shower enclosure and shielded from water by the towel curtain.

15. The method of claim 14 using a towel curtain assembly wherein the gripper has first and second grip surfaces, and the gripping step is performed by moving said first grip surface relative to said second grip surface to clamp the support therebetween; and wherein said mount end has a hole and said mount is a pivot mount having a cylinder extending into said hole for rotatably bearing movement of said towel curtain rod relative to said pivot mount.

16. The method of claim 14 wherein the support is a shower rod to which the towel curtain assembly is gripped.

17. The method of claim 14 wherein the support is a top of a shower door to which the towel curtain assembly is gripped.

18. The method of claim 14 wherein the support is a towel rod within the shower enclosure to which the towel curtain assembly is gripped.

19. A towel curtain assembly for keeping a towel dry within a shower in use comprising:

a gripper having opposing first and second grip surfaces, said first grip surface movably mounted for moving relative to said second grip surface for gripping a support;

a mount attached to a first end of said gripper;

a towel curtain rod mounted to said mount, said towel curtain rod mountable to said mount in at least a first orientation extending generally along and to a side of the support; and a towel curtain mounted on said towel curtain rod such that a towel placed on the support will be shielded from water by the towel curtain.

20. The towel curtain assembly of claim 19 wherein said mount is a pivot mount such that said towel curtain rod is positionable in a second orientation extending horizontally and away from the support.

* * * * *